US009004392B1

(12) United States Patent
Bigbee, Jr. et al.

(10) Patent No.: US 9,004,392 B1
(45) Date of Patent: Apr. 14, 2015

(54) APPARATUS AND METHOD FOR SPOOLING WIRE

(75) Inventors: William T. Bigbee, Jr., Melissa, TX (US); John L. Rhoads, McKinney, TX (US)

(73) Assignee: Encore Wire Corporation, McKinney, TX (US)

( * ) Notice: Subject to any disclaimer, the term of this patent is extended or adjusted under 35 U.S.C. 154(b) by 331 days.

(21) Appl. No.: 13/545,501

(22) Filed: Jul. 10, 2012

(51) Int. Cl.

| | |
|---|---|
| ***B65H 75/14*** | (2006.01) |
| ***B65H 75/40*** | (2006.01) |
| ***B65H 75/44*** | (2006.01) |
| ***B65H 75/18*** | (2006.01) |

(52) U.S. Cl.
CPC ..... *B65H 75/146* (2013.01); *B65H 75/18* (2013.01); *B65H 75/40* (2013.01); *B65H 75/44* (2013.01)

(58) Field of Classification Search
CPC ..... B65H 75/18; B65H 75/40; B65H 75/44; B65H 75/146
USPC ..... 242/403, 588, 600, 607, 608, 608.1, 242/614
See application file for complete search history.

(56) References Cited

U.S. PATENT DOCUMENTS

| | | | | |
|---|---|---|---|---|
| 3,152,772 | A * | 10/1964 | Schjerven | 242/557 |
| 3,652,026 | A * | 3/1972 | Awebro | 242/557 |
| 3,976,260 | A * | 8/1976 | Irik | 242/403 |
| 4,784,221 | A * | 11/1988 | Share et al. | 166/52 |
| 8,025,261 | B2 | 9/2011 | Jordan et al. | |
| 8,444,078 | B1 * | 5/2013 | Brown et al. | 242/403 |
| 2011/0095124 | A1 * | 4/2011 | Andrea et al. | 242/474.8 |

OTHER PUBLICATIONS

CarrisReels, "10-inch Caddies for in-th-box packaging reels from Carris Reels", Carris Reels, Inc. 2008, http://carris.com/products/caddy10.html. (Printed from website Oct. 11, 2012).

* cited by examiner

*Primary Examiner* — William E Dondero
(74) *Attorney, Agent, or Firm* — Warren Rhoades LLP

(57) ABSTRACT

An apparatus and method for spooling wire or cable from a reel assembly. In one embodiment, the apparatus comprises an inner flange assembly and an outer flange assembly. The inner flange assembly is capable of freely rotating relative to the outer flange assembly for spooling wire from any surface. In another embodiment, wire is spooled from a reel assembly comprising an inner flange assembly and an outer flange assembly.

14 Claims, 11 Drawing Sheets

APPARATUS AND METHOD FOR SPOOLING WIRE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

The present disclosure generally relates to apparatuses and methods for spooling wire, and more particularly, to a compact reel assembly capable of spooling wire independent of a jack stand or other reel support or spooling device.

2. Description of Related Art

To distribute electricity throughout a building, insulated electrical wires or cables are installed between a power source and a power distribution box and routed to electrical boxes to supply electricity to a device. Often, these electrical wires or cables are routed through multiple conduits throughout the building spanning great distances. As such, installing electrical wires presents both logistical and mechanical challenges. Wires are typically installed in a building by pulling the wire via pulling cables through the building's infrastructure. The wire is spooled off of a reel assembly during the wire pulling process.

Wire is typically transported from a wire manufacturing site to the building construction site on the reel assembly. These reel assemblies can have diameters of up to 48 inches or more, and are capable of carrying thousands of pounds of wire. At the construction site, construction workers are faced with the challenge of spooling the large bulk of wire from the reel assembly during a wire pull. The reel assembly is usually lifted off of the ground and set upon a pair of jack stands, which allows the reel to freely spin during a wire pull. During a wire pull, one end of the wire is attached to a pulling cable. Today, electric-powered machines are used to apply a pulling tension to the pulling cable, thereby spooling the wire off of the reel and through the building's infrastructure.

The use of jack stands to support the reel assembly during a wire pull has a number of significant disadvantages. For example, it requires heavy machinery to lift a large reel from the ground to the jack stand platform. This use of heavy machinery is both costly and dangerous to construction workers. Also, jack stands are themselves large pieces of equipment. They are difficult to transport, and when installed, they consume a large amount of floor space at a construction site. For smaller construction sites, the jack stand can present significant space challenges during construction. One solution to the above is to deliver the reel and wire to the construction site on a portable jack stand installed on a flat-bed truck. However, this solution also has many disadvantages. First, the jack stands are large and limit the amount of available flat-bed space to transport multiple reels. Second, flat-bed trucks can take up a large amount of space at a construction site when positioned for spooling. Another solution is to use portable jack stands with built-in lifting mechanisms.

However, these jack stands require additional equipment, and again, they can take up an inconvenient amount of space at a construction site.

Thus, there is need in the art for an apparatus and method that eliminates the need to use a jack stand to spool wire from a reel during a wire pull. There is also need in the art for a reel system that is compact, easily transportable, and capable of spooling wire while resting on the ground or some other surface.

BRIEF SUMMARY OF THE INVENTION

The present disclosure is directed to an apparatus for spooling wire. In a preferred embodiment, the apparatus is a reel assembly comprising an inner flange assembly and an outer flange assembly. The inner flange assembly is supported by the outer flange assembly and capable of freely rotating relative to the outer flange assembly.

In another embodiment, a method is disclosed for spooling wire from a reel. The reel assembly comprises an inner flange assembly and an outer flange assembly. Wire is wrapped around the inner flange assembly for spooling. The inner flange assembly is supported by the outer flange assembly and capable of freely rotating relative to the outer flange assembly. Wire is spooled from the reel assembly while the assembly rests directly on the ground or some other surface.

BRIEF DESCRIPTION OF THE SEVERAL VIEWS OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown.

In the drawings.

DETAILED DESCRIPTION OF THE INVENTION

Figure 1A:
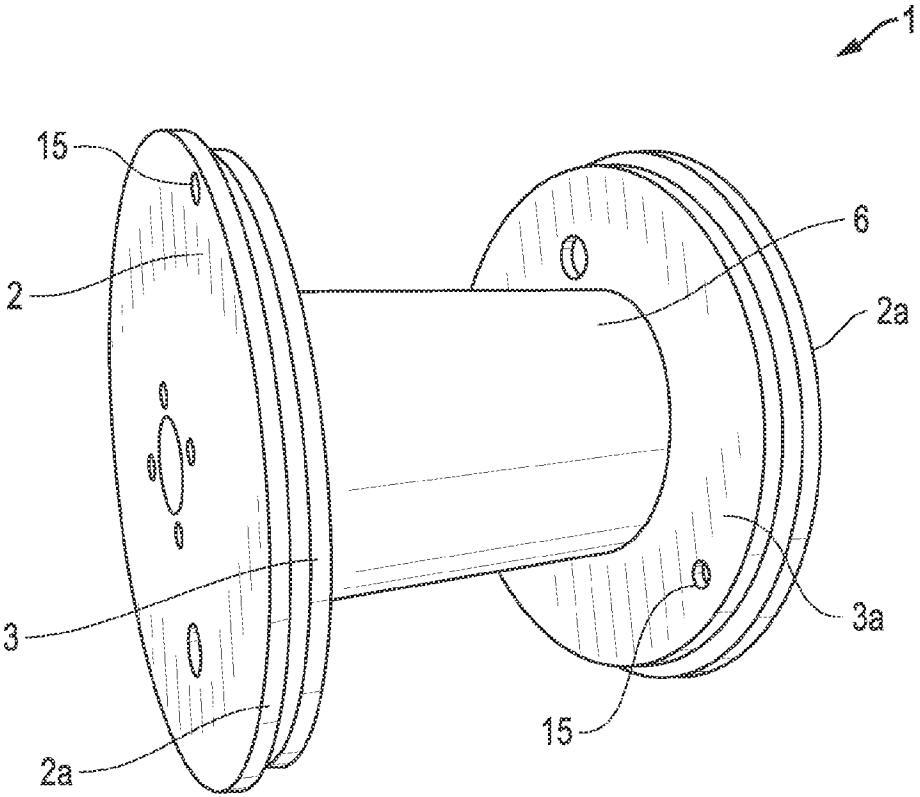
FIGS. 1A-1E illustrate various embodiments of the reel assembly.
Figure 1B:
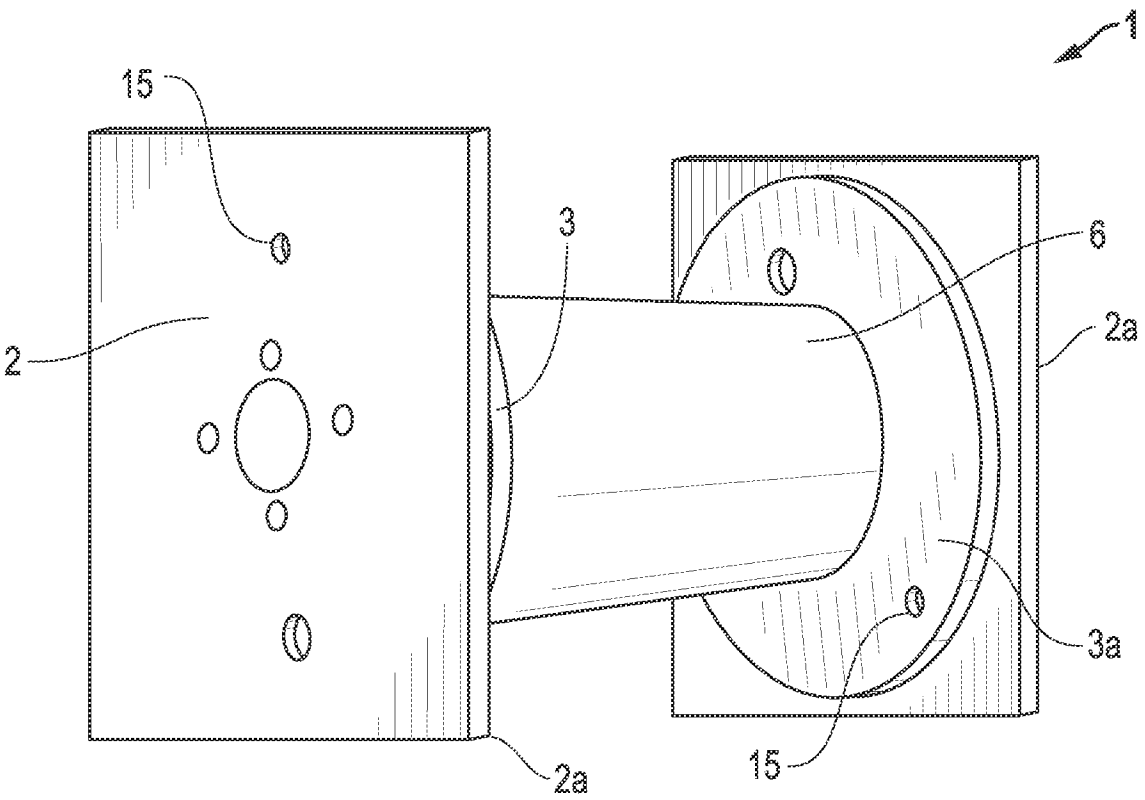
Figure 1C:
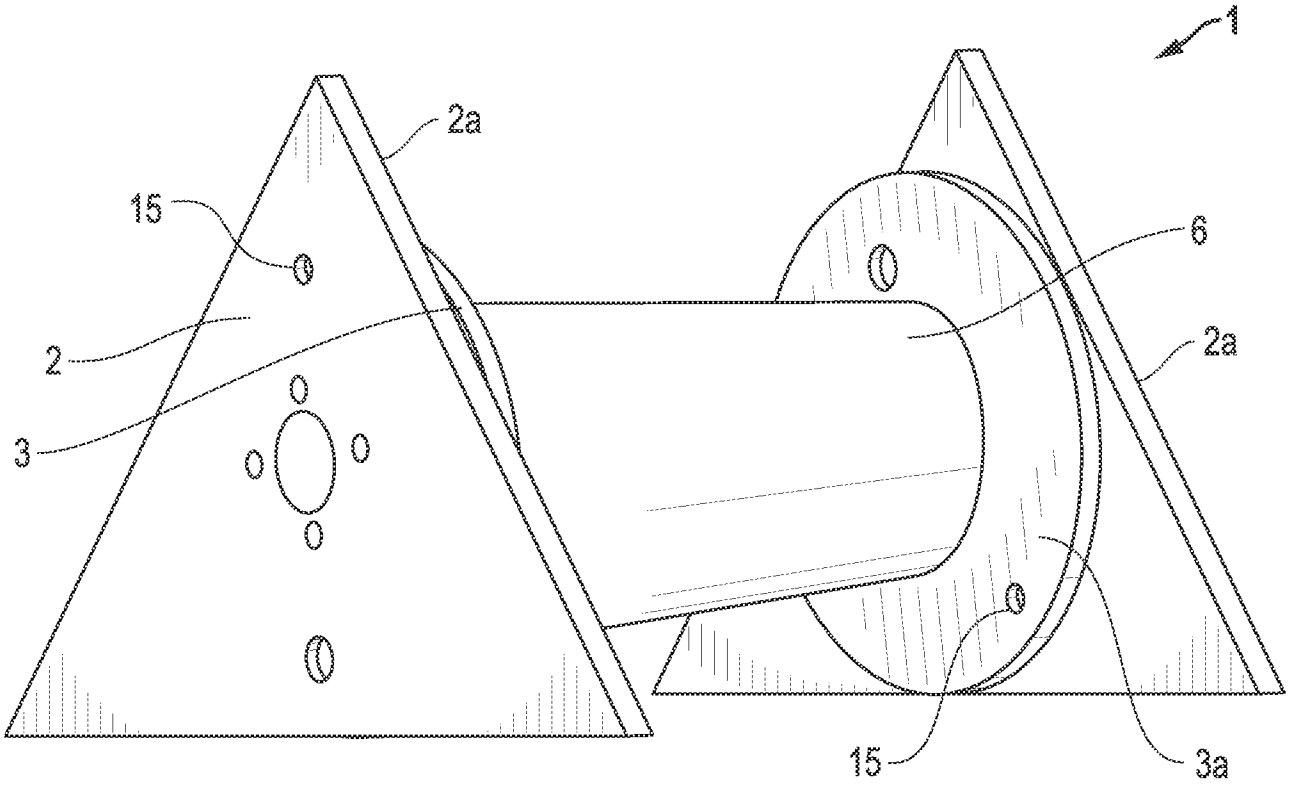
Figure 1D:
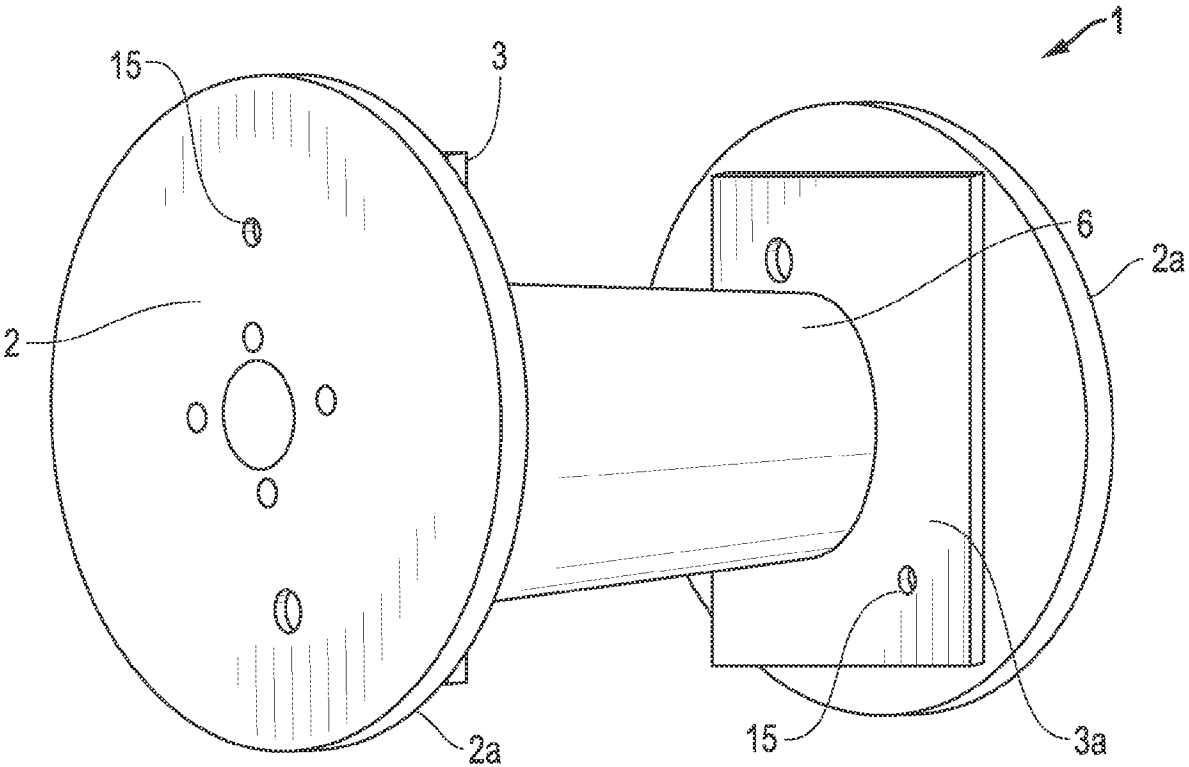
Figure 1E:
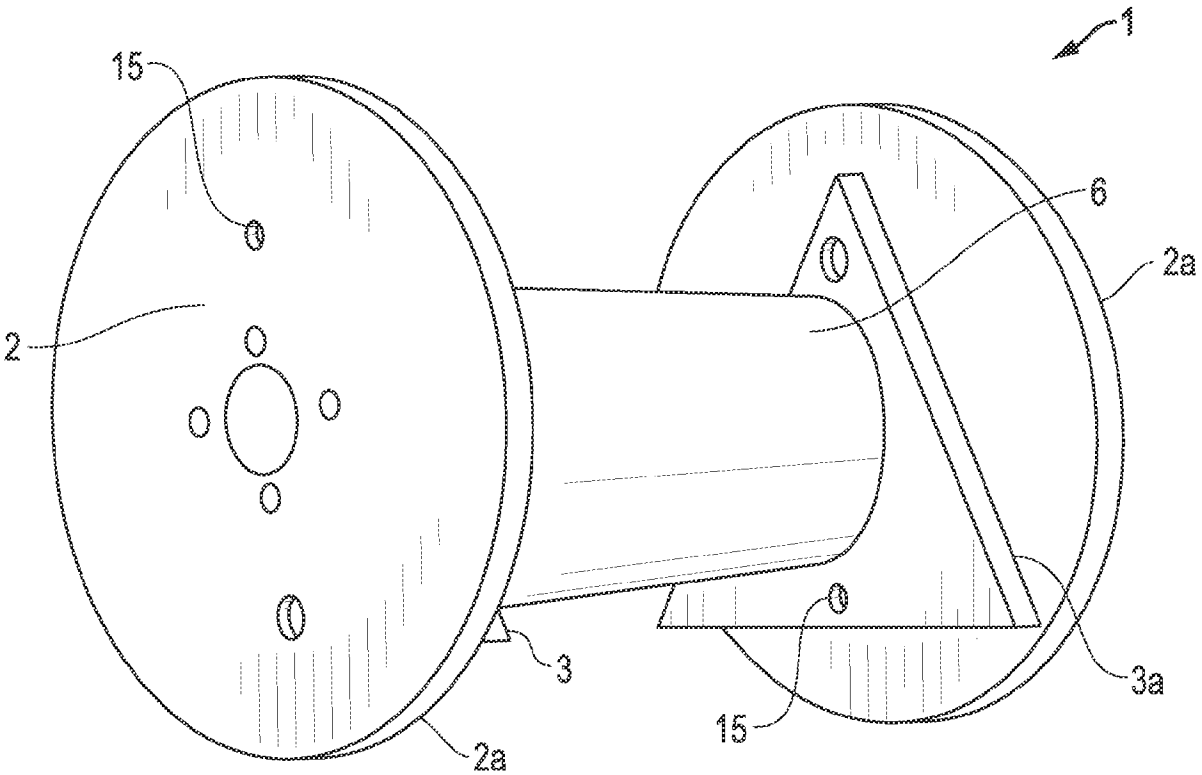
Figure 2:
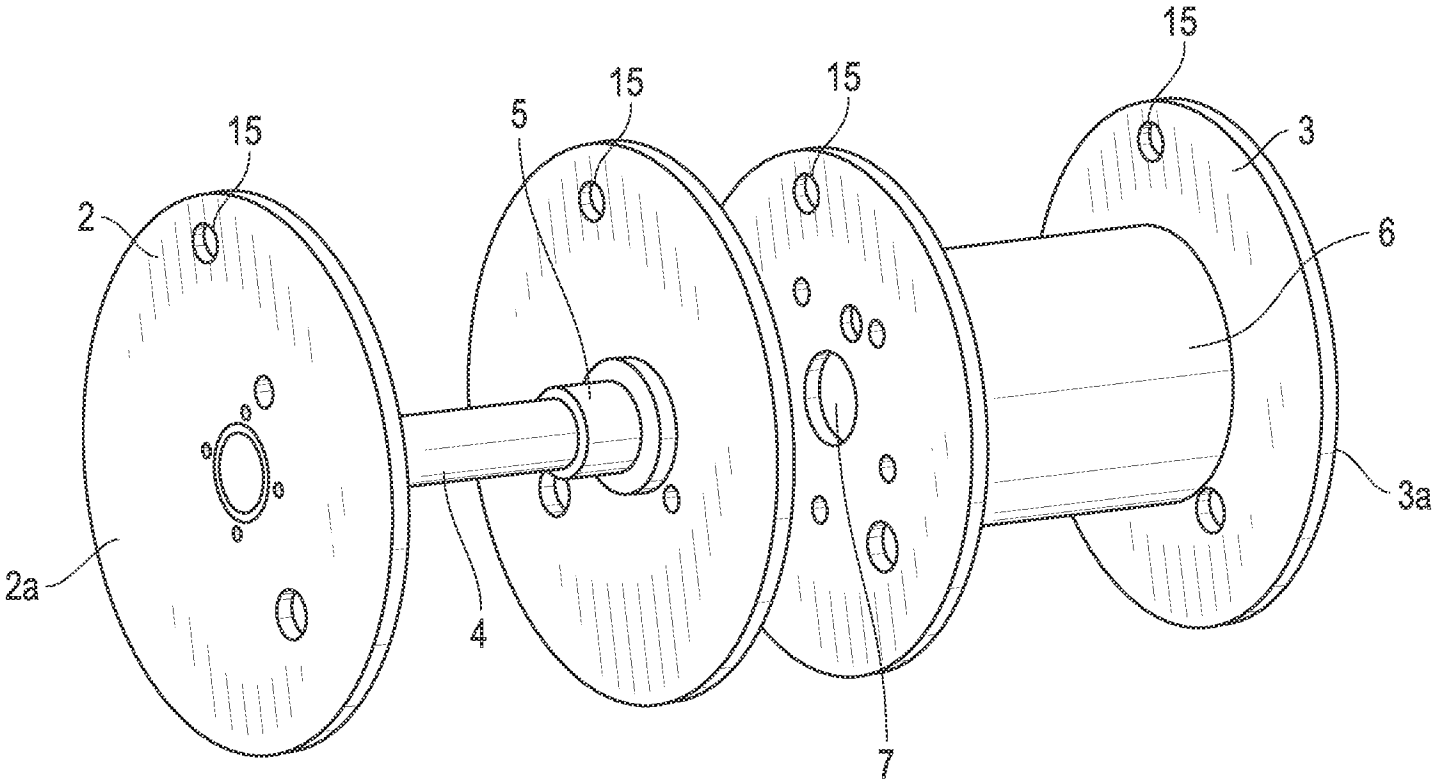
FIG. 2 illustrates the outer and inner flange components of one embodiment of the reel assembly.
Figure 3:
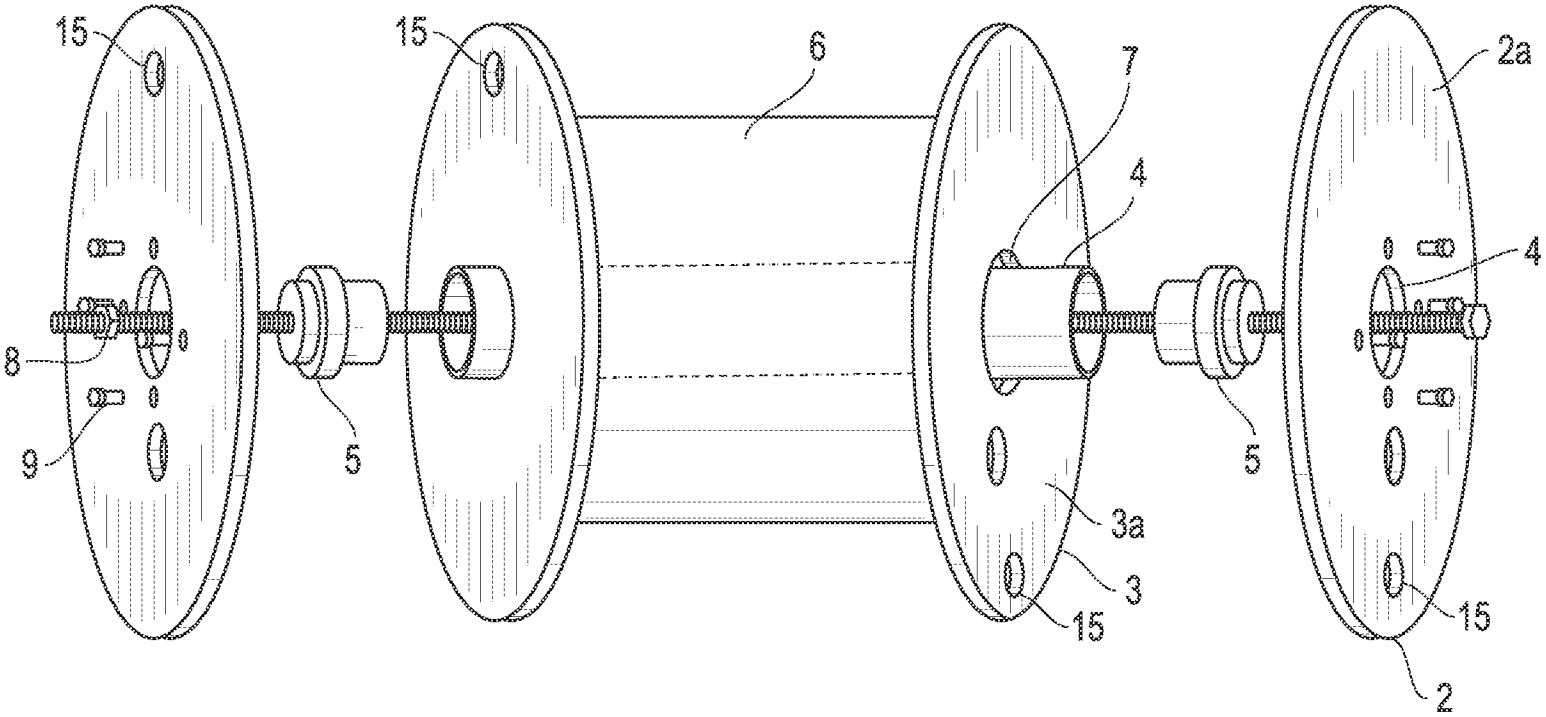
FIG. 3 illustrates one embodiment of the reel assembly.
Figure 4:
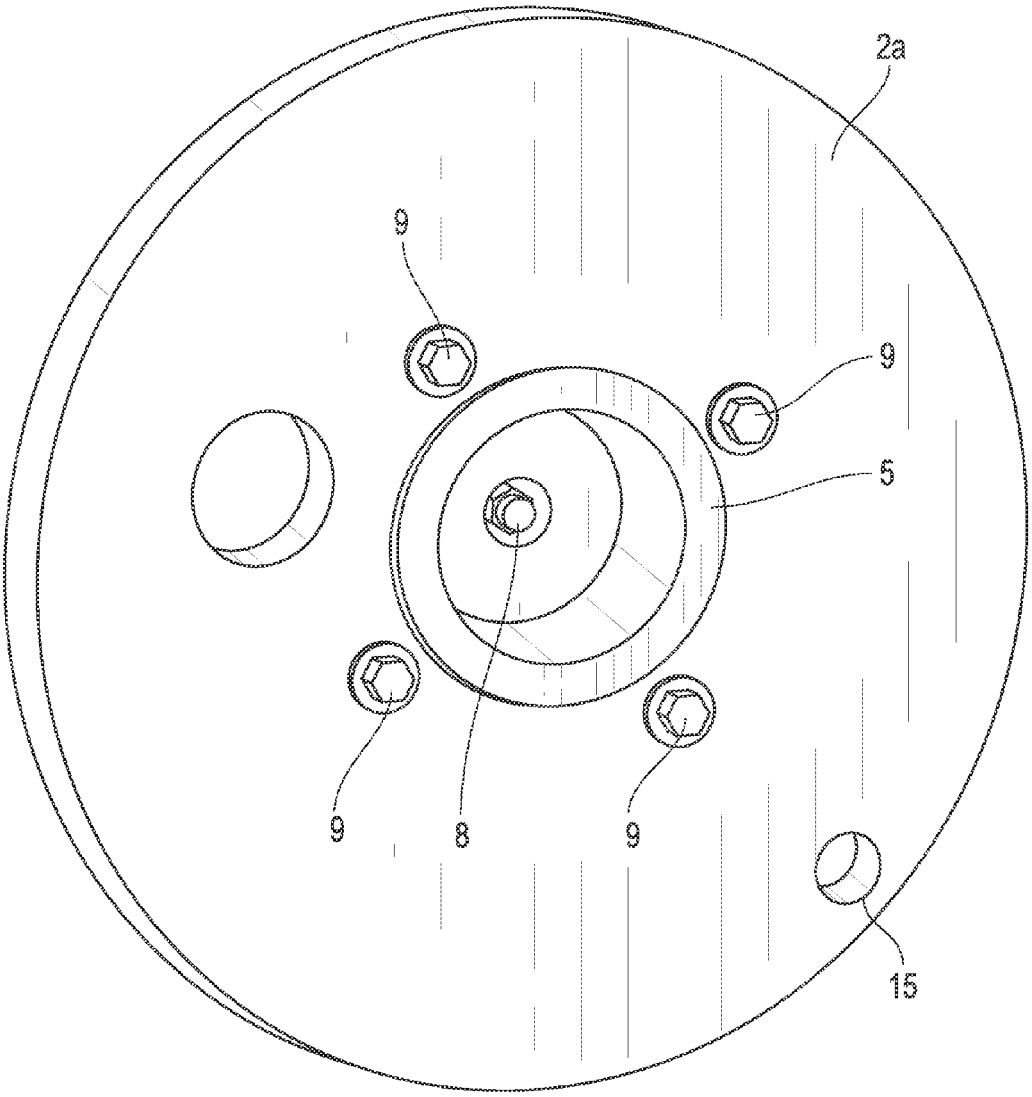
FIG. 4 illustrates one embodiment of a bearing and outer flange attachment.
Figure 5:
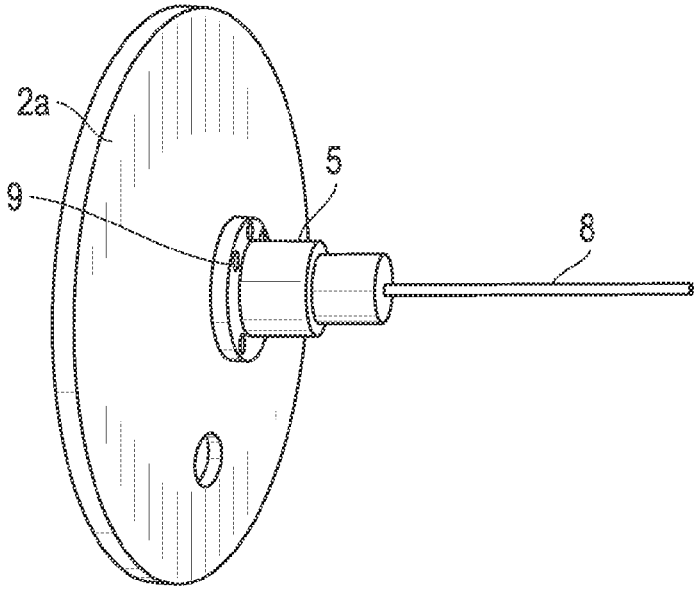
FIG. 5 illustrates one embodiment of a bearing and outer flange attachment.
Figure 6:
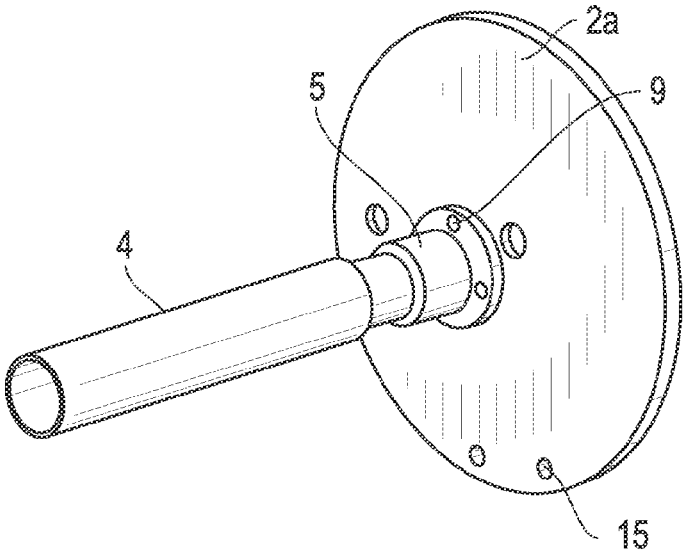
FIG. 6 illustrates one embodiment of a bearing and outer flange attachment.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It should be understood that any one of the features of the invention may be used separately or in combination with other features. Other systems, methods, features, and advantages of the present invention will be or become apparent to one with skill in the art upon examination of the drawings and the detailed description. It is intended that all such additional systems, methods, features, and advantages be included within this description, be within the scope of the present invention, and be protected by the accompanying claims.

The present disclosure is described below with reference to the Figures in which various embodiments of the present invention are shown. The subject matter of the disclosure may, however, be embodied in many different forms and should not be construed as limited to the exemplary embodiments set forth herein. It is also understood that the term "wire" is not limiting, and refers to wires, cables, electrical lines, or any other materials that are spooled from a reel.

The present disclosure is directed to an apparatus and method for spooling wire. In a preferred embodiment, the apparatus is a reel assembly comprising an inner flange assembly and an outer flange assembly. The inner flange assembly is supported by the outer flange assembly and capable of freely rotating relative to the outer flange assembly. With this design, wire can be spooled from the reel assembly while the assembly rests directly on the ground or some other surface.

Referring to FIGS. 1A-1E, 2 and 3 by way of non-limiting example, and consistent with embodiments of the invention, a reel assembly 1 is shown. The reel assembly 1 comprises two major components—an outer flange assembly 2 and an inner flange assembly 3. The outer flange assembly 2 comprises two outer supporting walls 2*a* of substantially equal shape and size connected by a bearing assembly comprising a tube 4 and bearings 5. The outer supporting 2*a* walls can be various shapes, including but not limited to circular, quadrilateral, or triangular. In a preferred embodiment, the outer supporting walls 2*a* are circular.

The inner flange assembly 3 also comprises two inner supporting walls 3*a* of substantially equal shape and size connected by a spooling seat 6. The inner supporting walls 3*a* of the inner flange assembly 3 can also be various shapes, including but not limited to circular, quadrilateral, or triangular. In a preferred embodiment, the inner supporting walls 3*a* are circular. Furthermore, in a preferred embodiment, the inner supporting walls 3*a* are slightly smaller than the outer supporting walls 2*a*. For example the overall dimensions of the inner supporting walls 3*a* are less than the outer supporting walls 2*a* to allow free spinning of the inner flange assembly 3 relative to the outer flange assembly 2. The distance between the inner supporting walls 3*a* is designed to be slightly smaller than the distance between the outer supporting walls 2*a*. As such, the inner flange assembly 3 is designed to fit within the outer flange assembly 2 between the outer supporting walls 2*a*. The inner flange assembly 3 further comprises a bore 7 through the center of the inner supporting walls 3*a* and spooling seat 6. The bore 7 is designed to receive the tube 4 of the outer flange assembly 2 so that the inner flange assembly 3 is supported by the outer flange assembly 2.

When assembled, the inner flange assembly 3 is capable of freely rotating about the bearing assembly. As the inner flange assembly 3 rotates the outer flange assembly 2 remains stationary. In this way, wire can be spooled from the reel assembly while the assembly rests on the ground or any other surface.

The outer supporting walls 2*a* are connected via a bearing assembly comprising a tube 4, bearings 5, a long bolt 8 and attachment bolts 9. The tube 4 and bearings 5 can be made of any number of materials, including but not limited to steel, plastics or polyacetal. In a preferred embodiment, the bearings 5 are made of polyacetal, which has low weight and has low coefficients of friction, and the tube 4 is made of steel. Referring to FIGS. 3-6 by way of non-limiting example, and consistent with embodiments of the invention, the bearings 5 are connected to the inner surfaces of the outer supporting walls 2*a*. It is understood by a person of ordinary skill in the art that any number of means can be used to attach the bearings 5 to the outer supporting walls 2*a*, including but not limited to bolts, screws or glues. In a preferred embodiment the bearings 5 are fastened to the outer supporting walls 2*a* via attachment bolts 9. Each end of the tube 4 is connected to a surface of each of the bearings 5 wherein the tube 4 and bearings 5 are adapted to allow the inner flange assembly 3 to freely rotate. The outer supporting walls 2*a* are secured to the bearings 5 via a long bolt 8 such that the tube 4 is sandwiched on and between bearings 5. The long bolt passes from one of the outer supporting walls 2*a*, through a first bearing 5, through the tube 4, through a second bearing 5, and through a second outer supporting wall 2*a*.

Figure 7:
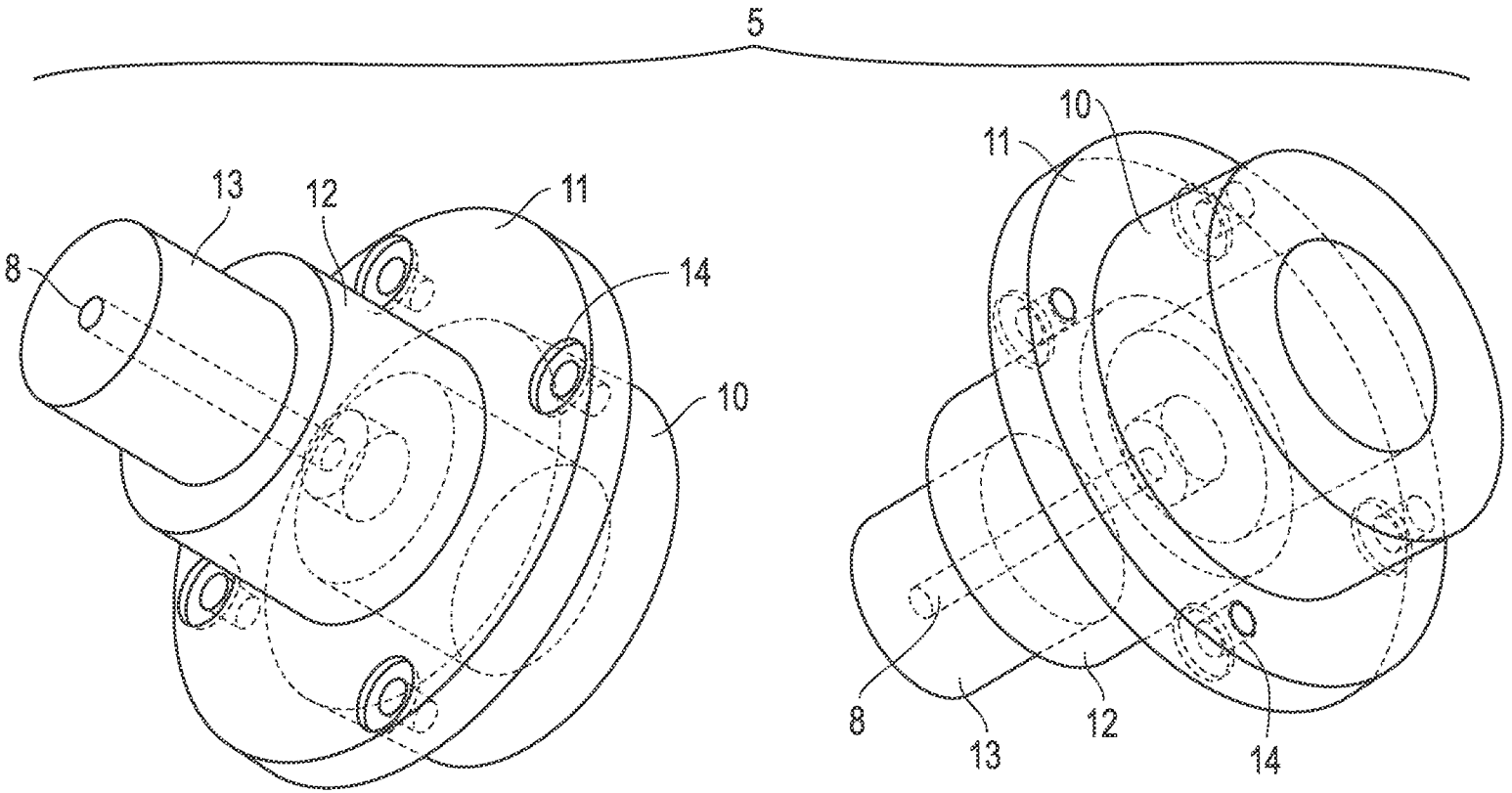
FIG. 7 illustrates one embodiment of a bearing.

A preferred embodiment of the bearings 5 is depicted in FIG. 7. The bearings 5 comprise primarily four stages 10, 11, 12 and 13. The first stage 10 is designed to mate with a bore of an outer supporting wall 2*a*. The second stage 11 includes bolt holes 14 and is designed to secure the bearings 5 to the inner surface of the outer supporting wall 2*a*. The third stage 12 is designed to maintain a separation between the inner supporting walls 3*a* of the inner flange assembly 3 and the outer supporting walls 2*a* of the outer flange assembly 2. In this way, the inner flange assembly 3 is able to freely rotate relative to the outer flange assembly 2. Finally, the fourth stage 13 is sized to mate with the tube 4.

Figure 8:
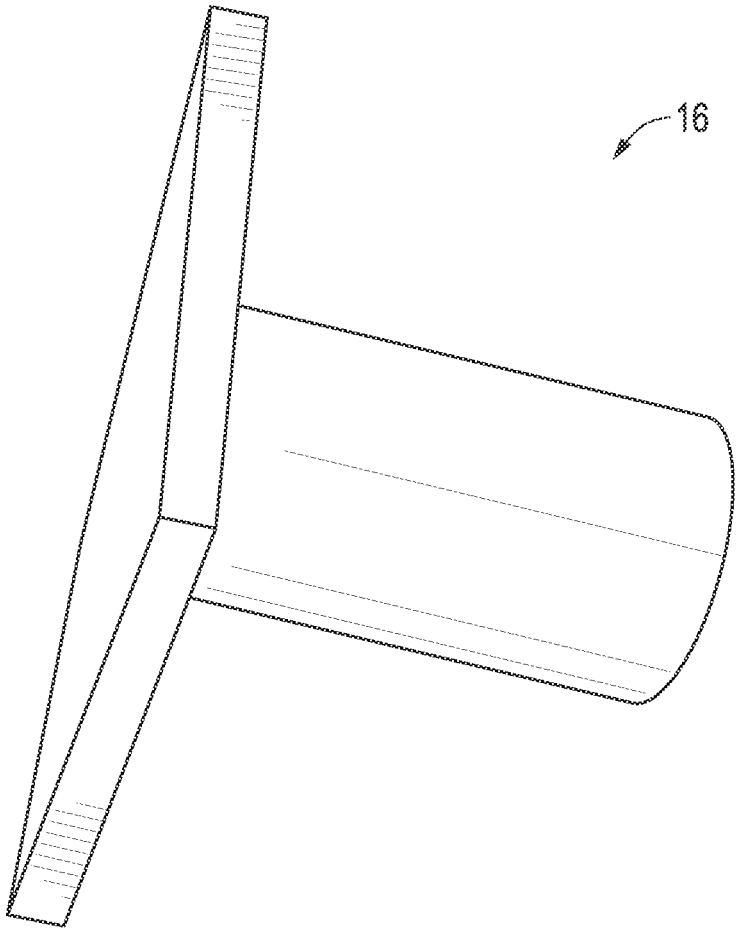
FIG. 8 illustrates one embodiment of a plug for preventing rotation of the inner flange assembly.

In an alternative embodiment, the outer supporting walls 2*a* and inner supporting walls 3*a* comprise holes 15 to receive a plug 16. As shown in FIG. 8, a plug 16 is designed to fit through the outer supporting wall and inner supporting wall holes 15 (see FIGS. 1, 2, 3). When the plug 16 is placed through the holes 15 in both the outer supporting wall 2*a* and the inner supporting wall 3*a* the inner flange assembly 3 is secured in a locked position to the outer flange assembly 2 and thereby unable to freely rotate.

In another embodiment of the invention, wire is spooled from the reel assembly 1 during a wire pulling event. The reel assembly 1 comprises an inner flange assembly 3 and an outer flange assembly 2. Wire is wrapped around the inner flange assembly 3 for spooling. The inner flange assembly 3 is supported by the outer flange assembly 2 and capable of freely rotating relative to the outer flange assembly 2. Wire is spooled from the reel assembly 1 while the assembly rests directly on the ground or some other surface.

One skilled in the art will recognize that different embodiments may be formed in a similar manner having different characteristics depending upon need, performance, or some other criteria. It will thus be appreciated by those skilled in the art that changes could be made to the embodiments described above without departing from the broad inventive concept thereof. It is understood, therefore, that the invention disclosed herein is not limited to the particular embodiments disclosed, but it is intended to cover modifications within the spirit and scope of the present invention as defined by the appended claims.

What is claimed is:

1. An apparatus for spooling wire comprising:

an inner flange assembly, wherein the inner flange assembly includes a first inner supporting wall and a second inner supporting wall, wherein the first and second inner supporting walls include an inner locking hole;

an outer flange assembly, wherein the inner flange assembly is capable of freely rotating relative to the outer flange assembly, and wherein the outer flange assembly includes a first outer supporting wall and a second outer supporting wall, wherein the first and second outer supporting walls include an outer locking hole; and a locking plug for insertion into the inner and outer locking holes, wherein the inner flange assembly cannot freely rotate relative to the outer flange assembly when the locking plug is inserted into the inner and outer locking holes and wherein the locking plug, when inserted, extends between only one outer supporting wall and the adjacent inner supporting wall.

2. The apparatus of claim 1, wherein the outer supporting walls are connected via a bearing assembly.

3. The apparatus of claim 2, wherein the outer supporting walls and the bearing assembly are fixed together by a long bolt.

4. The apparatus of claim 2, wherein the inner flange assembly rotates about the bearing assembly.

5. The apparatus of claim 2, wherein the bearing assembly is made of one or more of steel, plastic or polyacetal.

6. The apparatus of claim 1, wherein the inner flange assembly is fixed to the outer flange assembly by a single plug inserted through a single inner locking hole and a single outer locking hole.

7. The apparatus of claim 1, wherein the outer supporting walls or inner supporting walls are any combination of circular, quadrilateral or triangular.

8. A method of spooling wire, comprising:

spooling wire from a reel assembly; and wherein the reel assembly comprises an inner flange assembly, wherein the inner flange assembly includes a first inner supporting wall and a second inner supporting wall, wherein the first and second inner supporting walls include an inner locking hole, an outer flange assembly, wherein the inner flange assembly is capable of freely rotating relative to the outer flange assembly, and wherein the outer flange assembly includes a first outer supporting wall and a second outer supporting wall, wherein the first and second outer supporting walls include an outer locking hole, and a locking plug for insertion into the inner and outer locking holes, wherein the inner flange assembly cannot freely rotate relative to the outer flange assembly when the locking plug is inserted into the inner and outer locking holes and wherein the locking plug, when inserted, extends between only one outer supporting wall and the adjacent inner supporting wall.

9. The method of claim 8, wherein the outer supporting walls are connected via a bearing assembly.

10. The method of claim 9, wherein the outer supporting walls and the bearing assembly are fixed together by a long bolt.

11. The method of claim 9, wherein the inner flange assembly rotates about the bearing assembly.

12. The method of claim 9, wherein the bearing assembly is made of one or more of steel, plastic or polyacetal.

13. The method of claim 8, wherein the inner flange assembly is fixed to the outer flange assembly by a single plug inserted through a single inner locking hole and a single outer locking hole.

14. The method of claim 8, wherein the outer supporting walls or inner supporting walls are any combination of circular, quadrilateral or triangular.

* * * * *